US006088094A

United States Patent [19]

Chu et al.

[11] Patent Number: 6,088,094

[45] **Date of Patent: *Jul. 11, 2000**

[54] ON-LINE SLIVER MONITOR

[75] Inventors: Youe-Tsyr Chu, Knoxville; Joseph M. Yankey, Loudon; Michael H. Reynolds, Knoxville; Ian F. Oxley, Knoxville; Stefan Weidmann, Knoxville; Hossein M. Ghorashi, Knoxville, all of Tenn.

[73] Assignee: Zellweger Uster, Inc., N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,153

[22] Filed: Dec. 23, 1997

[51] Int. Cl.[7] ..... G01N 21/00

[52] U.S. Cl. ..... 356/238.3; 356/429; 19/65 A

[58] Field of Search ..... 356/238.1, 238.2, 356/238.3, 430, 429; 250/559.11, 559.41, 559.01, 559.08, 559.4; 19/161.1, 303, 297, 65 A, 98, 0.25, 239; 348/88, 125, 132

[56] References Cited

U.S. PATENT DOCUMENTS

| | | | |
|---|---|---|---|
| 3,157,915 | 11/1964 | Gilbo | 356/429 |
| 4,213,056 | 7/1980 | Matsumura et al. | 250/559.01 |
| 4,490,618 | 12/1984 | Cielo | 356/429 |
| 4,936,141 | 6/1990 | Anderson, Jr. et al. | 250/559.01 |
| 5,092,678 | 3/1992 | Chase et al. | 250/559.01 |
| 5,101,672 | 4/1992 | Anthony et al. | 73/863 |
| 5,130,559 | 7/1992 | Leifeld et al. | 250/562 |
| 5,194,911 | 3/1993 | Stutz | 356/429 |
| 5,355,561 | 10/1994 | Faas | 356/429 |
| 5,394,480 | 2/1995 | Shofner et al. | 382/1 |
| 5,533,145 | 7/1996 | Shofner et al. | 382/141 |
| 5,692,267 | 12/1997 | Leifeld | 356/237 |

OTHER PUBLICATIONS

Loptex, Optalyser OP 300 brochure, date unknown.

Schlichter, Trutzschler nep tester NT: a new visual method to analyze neps and interfering particles, Textile Praxis International, pp. 28–29, Sep., 1991.

Trutzschler, Nep Tester NT brochure, date unknown.

Lintronics, Fiber Contamination Tester brochure, date unknown.

Lieberman and Zhao, Categorizing Cotton Trash Shapes Using Video Imagery, Beltwide Cotton Conference, pp. 854–858, 1991.

Lieberman, Bragg, and Brennan, Determining Gravimetric Bark Content in Cotton with Machine Vision, Textile Res. J., pp. 94–104, Feb. 1998.

Zellweger Uster, Uster LVI brochure, date unknown.

Zellweger Uster, Uster Micronaire 775 brochure, date unknown.

Zellweger Uster, Uster HVI 900 brochure, date unknown.

Peyer, texLAB brochure, date unknown.

Peyer, FL–100 manual (2 pages only), date unknown.

Benardin, Delfosse, Measurement of fiber lengths distribution on raw wool, Melliand International, pp. 70–74, Feb., 1996.

Motion Control, breaker drawings (2), Oct., 1994.

*Primary Examiner*—Hoa Q. Pham

*Attorney, Agent, or Firm*—Luedeka, Neely & Graham, PC

[57] ABSTRACT

A device for measuring properties of fiber in a sliver is constructed with a first and second curved aluminum guide piece that is coated with either Teflon or ceramic. The guides compress the sliver of fiber. A Xenon bulb provides light which passes through a first transparent window located in the first guide piece. The light then passes through the sliver of fiber and out of a second transparent window located in the second curved guide piece. The light is then focused by optics upon a charge coupled device camera. The charge coupled device camera uses an array of pixels to create an image of the compressed sliver of fiber. A pulse generator provides simultaneous trigger signals to the Xenon bulb and the camera so that the image of the sliver of fiber is created at the same time as the light is produced. Processing means identify patterns of dark pixels in the array as trash, neps, seed coat neps, and other impurities in the fiber by comparing the patterns of pixels in the array with patterns in a lookup table.

31 Claims, 3 Drawing Sheets

| | 1 | 2 | 3 | 4 | 5 | 6 |
|---|---|---|---|---|---|---|
| 1 | 1 | 1 | 2 | 2 | 1 | 1 |
| 2 | 1 | 2 | 3 | 4 | 3 | 2 |
| 3 | 1 | 2 | 4 | 2 | 2 | 2 |
| 4 | 2 | 4 | 2 | 1 | 1 | 2 |
| 5 | 3 | 4 | 3 | 2 | 2 | 3 |
| 6 | 4 | 3 | 2 | 2 | 3 | 3 |

| | 1 | 2 | 3 | 4 | 5 | 6 |
|---|---|---|---|---|---|---|
| 1 | | | | | | |
| 2 | | | 3 | 4 | 3 | |
| 3 | | | 4 | | | |
| 4 | | 4 | | | | |
| 5 | 3 | 4 | 3 | | | 3 |
| 6 | 4 | 3 | | | 3 | 3 |

| | 1 | 2 | 3 | 4 | 5 | 6 |
|---|---|---|---|---|---|---|
| 1 | | | | | | |
| 2 | | | 3 | 4 | 3 | |
| 3 | | | 4 | | | |
| 4 | | 4 | | | | |
| 5 | 3 | 4 | 3 | | | |
| 6 | 4 | 3 | | | | |

| | 1 | 2 | 3 | 4 | 5 | 6 |
|---|---|---|---|---|---|---|
| 1 | | | | | | |
| 2 | | | 165 | 207 | 154 | |
| 3 | | | 197 | | | |
| 4 | | 201 | | | | |
| 5 | 172 | 213 | 151 | | | |
| 6 | 247 | 180 | | | | |

ON-LINE SLIVER MONITOR

FIELD OF THE INVENTION

The present invention is directed to fiber monitoring, and more particularly to an on-line sliver monitor that detects impurities in a sliver of cotton.

BACKGROUND OF THE INVENTION

Fiber properties, including impurities such as neps and trash particles, affect the quality and value of a fiber such as cotton. Thus, it is important to monitor the presence of impurities in fiber when it is being processed. Once impurities are detected, the production machinery may be altered to reduce or eliminate the neps and trash. Because trash and neps may contaminate the fiber at almost any stage of production, it is important to monitor the quality of the fiber at many different stages of the processing operation.

Some fiber quality testing equipment requires that fiber samples be removed from the material that is being processed. This is undesirably time consuming and often difficult to accomplish. Furthermore, because of the speed of fiber moving through modern processing equipment, the results of a quality test may be irrelevant by the time the test results are received. In addition, the processing equipment may need to be stopped to remove a sample. This can result in costly delays and diminished production.

Some fiber quality monitoring devices are fully integrated into fiber processing equipment. While this might be a desirable feature to one who needs new equipment or has compatible equipment, it does not benefit those who already have incompatible equipment.

At certain points during cotton processing, the cotton is in a form known as a "sliver". A sliver of fiber is a bundle of substantially parallel, untwisted fibers, typically created at the output of a carding machine. The sliver of fiber is usually exposed as it exits the carding machine and is relatively easily accessible at this stage of processing. Therefore, it would be beneficial to monitor the fiber in sliver form at this point.

However, there are several disadvantages to monitoring fiber in sliver form. For example, the sliver of fiber is round and relatively thick. Due to the sliver's shape and thickness, it is hard to see the individual fibers, especially those fibers nearer the interior of the sliver. Furthermore, the sliver typically moves very fast through the processing equipment at this stage of production. Therefore, it is difficult to remove a sample at this stage of production without undesirably breaking the sliver of fiber. In addition, the speed of the moving sliver of fiber tends to make it difficult to create a clear image of the internal structure of the sliver with a camera.

Therefore, what is needed is an apparatus and method that can rapidly monitor the quality of a sliver of fiber on-line as it is being processed, and that can be used with existing fiber processing equipment.

SUMMARY OF THE INVENTION

The present invention overcomes deficiencies of the prior art by providing a device for measuring properties of fiber in a sliver. A guide receives and compresses the sliver of fiber. A light source produces light that is received by a first transparent window located in the guide, and which provides the light to the compressed sliver of fiber. A second transparent window, also located in the guide, receives the light from the compressed sliver of fiber. A camera receives the light from the second transparent window and creates an image of the compressed sliver of fiber.

Thus, the present invention overcomes the deficiencies of the prior art by providing a means of measuring the properties of fiber in a sliver without stopping the processing equipment or removing a sample. Furthermore, by providing means for measuring the properties of fiber in a sliver, the present apparatus allows processors of fiber to measure the properties of fiber at a time when it is easily accessible as it exits the carding machine and enters the coiler. This allows the on-line sliver monitor to be fitted to existing fiber processing equipment without extensive modifications. Therefore, the present invention can be used to upgrade the capabilities of existing processing equipment without the need to replace expensive machinery.

In accordance with a particular preferred embodiment of the present invention, a device is provided for measuring properties of fiber in a sliver. First and second curved aluminum guide pieces coated with at least one of Teflon or ceramic, form an open trumpet for compressing the sliver of fiber without drafting the sliver of fiber. A Xenon bulb provides light. A first transparent window located in the first aluminum guide piece receives the light from the Xenon bulb and provides the light to the compressed sliver of fiber. A second transparent window located in the second curved aluminum guide piece receives the light from the compressed sliver of fiber. A charge coupled device camera receives the light from the second transparent window. The camera has an array of pixels to create an image of the compressed sliver of fiber. Optics receive the light from the second transparent window and focus the light upon the charge coupled device camera. A pulse generator provides simultaneous trigger signals to the Xenon bulb and the charge coupled device camera. The trigger signal to the camera causes the camera to create the image of the compressed sliver of fiber, and the trigger signal to the Xenon bulb causes the bulb to produce light.

A processing means receives and analyzes the image of the compressed sliver of fiber created by the camera. The processing means also detects impurities in the compressed sliver of fiber by selecting as dark pixels those pixels which are darker than a threshold darkness. The processing means selects the dark pixels that are contiguous to at least four other dark pixels. These contiguous dark pixels form patterns. The selected dark pixels are assigned a value representing the dark pixel's darkness. The processing means classifies the patterns of dark pixels by examining the patterns of dark pixels to determine a darkness level, fuzziness level, and a shape. The processing means compares the patterns of dark pixels and darkness values against a lookup table to detect impurities in the compressed sliver of fiber.

In another preferred embodiment, the guide and transparent windows are a first and a second transparent roller that receive and compress the sliver of fiber. The light source is located in the first transparent roller and the camera is located in the second transparent roller. As the transparent rollers spin, the sliver of fiber is drawn between them, compressed, and then released.

In a method of monitoring properties of fiber in a sliver, the sliver of fiber is received and compressed. A light is directed toward the compressed sliver of fiber, and at least a portion of the light passes through the compressed sliver of fiber. The portion of light passing through the compressed sliver is received with an array of pixels, which creates an image of the compressed sliver of fiber. The image of the compressed sliver of fiber is analyzed to locate impurities in the compressed sliver of fiber. The sliver of fiber is released without drafting of the sliver of fiber.

The foregoing method is a considerable improvement over the prior art. Because the sliver can be rapidly compressed and released, the monitoring can be accomplished in real time as the fiber is being processed. Also, because it can monitor fiber in sliver form, the foregoing method can be relatively easily adapted to existing fiber processing equipment.

A preferred method of monitoring properties of fiber in a sliver includes receiving and compressing the sliver of fiber. A light is strobed and directed toward the compressed sliver of fiber such that at least a portion of the strobed light passes through the compressed sliver of fiber. The portion of strobed light passing through the compressed sliver of fiber is focused. The focused portion of strobed light passing through the compressed sliver of fiber is received with an array of pixels. Simultaneous trigger signals are provided to synchronize the strobing of the light and detection by the array of pixels. An image of the compressed sliver of fiber is created from the focused portion of the strobed light with the array of pixels. The image of the compressed sliver of fiber is analyzed to locate impurities in the compressed sliver of fiber, and the sliver of fiber is released without unacceptably drafting the sliver of fiber.

BRIEF DESCRIPTION OF THE DRAWING

Further advantages of the invention will become apparent by reference to the detailed description of preferred embodiments when considered in conjunction with the following drawings, which are not to scale, in which like reference numerals denote like elements throughout the several views, and wherein.

DETAILED DESCRIPTION OF THE PREFERRED EMBODIMENTS

Figure 1:
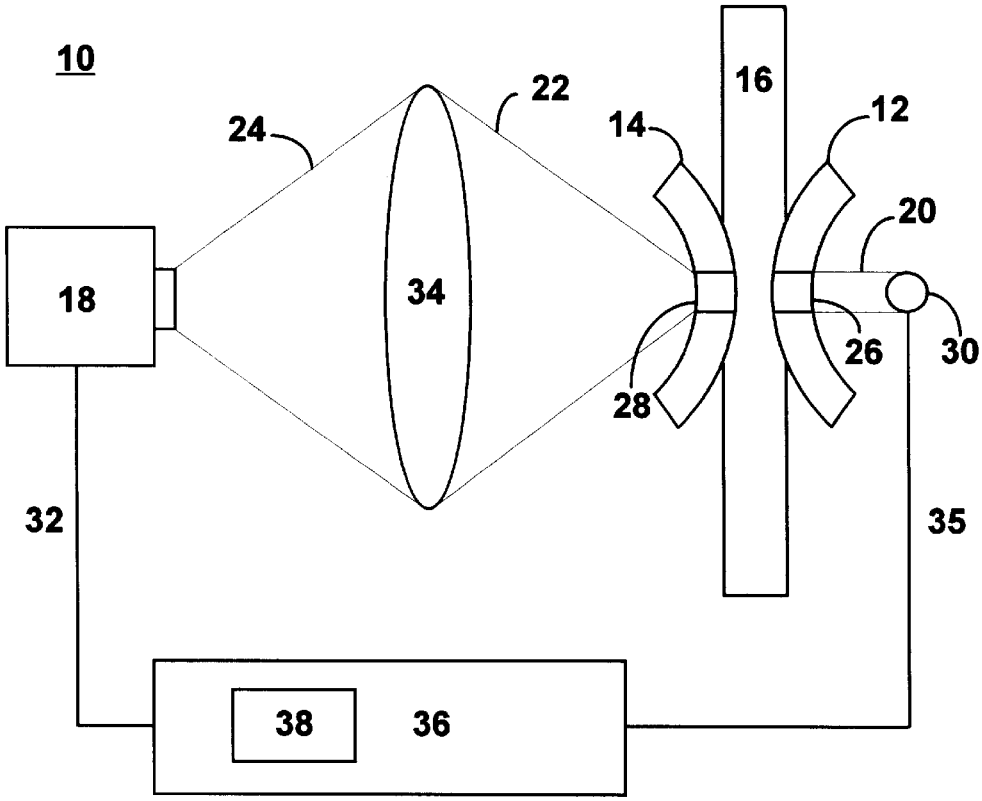
FIG. 1 is a functional diagram of a first embodiment of the on-line sliver monitor.

Referring to FIG. 1, an on-line sliver monitor 10 is shown that represents the present invention. The on-line sliver monitor 10 is particularly useful in combination with existing fiber processing equipment. This is because the present invention allows the fiber to be tested when it is in the form of a sliver 16. The sliver 16 of fiber is a bundle of substantially parallel fibers, in which the fibers are generally not twisted together, as they would be in a rope. Typically, fiber that is being processed is in the form of a sliver 16 when it exits the carding phase of the process. After carding, the sliver 16 of fiber progresses to a coiler that coils the sliver 16 of fiber into a can. Because the carding machine and the coiler are usually physically separated by at least some distance, the sliver 16 of fiber can be relatively easily accessed by the on-line sliver monitor 10 as the sliver 16 is fed from the carding machine into the coiler. Thus, the on-line sliver monitor 10 can be included in an existing fiber processing system without significantly modifying or replacing the existing equipment. Given the relatively high cost of fiber processing equipment, the ability to relatively easily add fiber monitoring equipment to existing systems is very beneficial.

However, the generally circular cross-section and relatively loose and non-compact nature of a sliver 16 of fiber makes it more difficult to take certain measurements on the sliver 16 of fiber. For example, measurements based on fiber density, which may be taken by passing light through the sliver 16, are generally difficult to accomplish, and typically yield erratic or otherwise unsatisfactory results. The embodiment of the on-line sliver monitor 10 shown in FIG. 1 receives and compresses the sliver 16 of fiber with a first curved guide piece 12 and a second curved guide piece 14. The guide pieces 12 and 14 are constructed out of any material that is strong and durable enough to compress the sliver 16 of fiber with a low enough coefficient of friction to allow the sliver 16 of fiber to pass through the guide pieces 12 and 14 without drafting the sliver 16 as discussed in more detail below.

The guide pieces 12 and 14 are curved with their convex sides facing one another. As the sliver 16 of fiber is drawn between the guide pieces 12 and 14, it is compressed, or in other words, its width is decreased by removing the air, spaces between the individual fibers. Thus, the gap between the guides 12 and 14 is essentially filled with fiber and impurities with relatively little air in between. However, compression of the sliver 16 along its length is kept to a minimum. The maximum compression of the circumference of the sliver 16 of fiber occurs when the sliver 16 of fiber passes between the guide pieces 12 and 14 at the point at which the guides 12 and 14 are closest. Thus, the maximum amount of compression of the sliver 16 of fiber can be varied by altering the minimum distance between the guide pieces 12 and 14. Compressing the sliver 16 of fiber flattens the sliver 16 of fiber and tends to reduce the scattering of light that is directed toward the sliver 16.

When receiving and compressing the sliver 16 of fiber, it is important that the sliver 16 of fiber not be significantly drafted. Drafting occurs when the sliver 16 of fiber is stretched or compressed along its length. If the sliver 16 of fiber is provided to the on-line sliver monitor 10 faster than it is released from the sliver monitor 10, then the sliver 16 of fiber is compressed along its length as it enters the monitor 10. Conversely, if the sliver 16 of fiber is pulled from the guides 12 and 14 faster than it is released from the guides 12 and 14, then the sliver 16 is stretched and the individual fibers are pulled apart. If the sliver 16 of fiber is drafted, its circumference and weight per unit length are usually altered. Since the sliver 16 of fiber may be processed after it leaves the sliver monitor 10 by machines that are designed to receive the sliver 16 of fiber with a particular circumference and density, it is important that the on-line sliver monitor 10 not significantly draft the sliver 16 of fiber.

The embodiment of the on-line sliver monitor 10 shown in FIG. 1 preferably prevents drafting of the sliver 16 of fiber by coating the inside of the guides 12 and 14 with a material having a relatively reduced coefficient of friction at the surface, that allows the sliver 16 of fiber to pass through the guides 12 and 14 with relatively little resistance. The amount of compression, or in other words the distance between the guides 12 and 14, also affects the tendency of the sliver 16 of fiber to draft. The optimal distance between the first guide piece 12 and the second guide piece 14 partially depends upon the width of the sliver 16 of fiber. If the guides 12 and 14 are too close together, the sliver 16 of fiber is compressed to the point that the force required to pull the sliver 16 through the guides 12 and 14 exceeds the amount necessary to draft the sliver 16 of fiber. Alternatively, if the distance between the guides 12 and 14 is too large, the sliver 16 of fiber is not adequately compressed as described more fully below. In the preferred embodiment, the guide pieces 12 and 14 are formed of aluminum coated with Teflon or ceramic inserts, and are between about six millimeters and about twelve millimeters apart. This work wells for a sliver 16 of fiber having a mass of between about 55 grains and about 90 grains. As used herein, and as is well known in the art, the mass of the sliver 16 of fiber in grains is defined as the weight of the sliver 16 of fiber per a given length.

Figure 3:
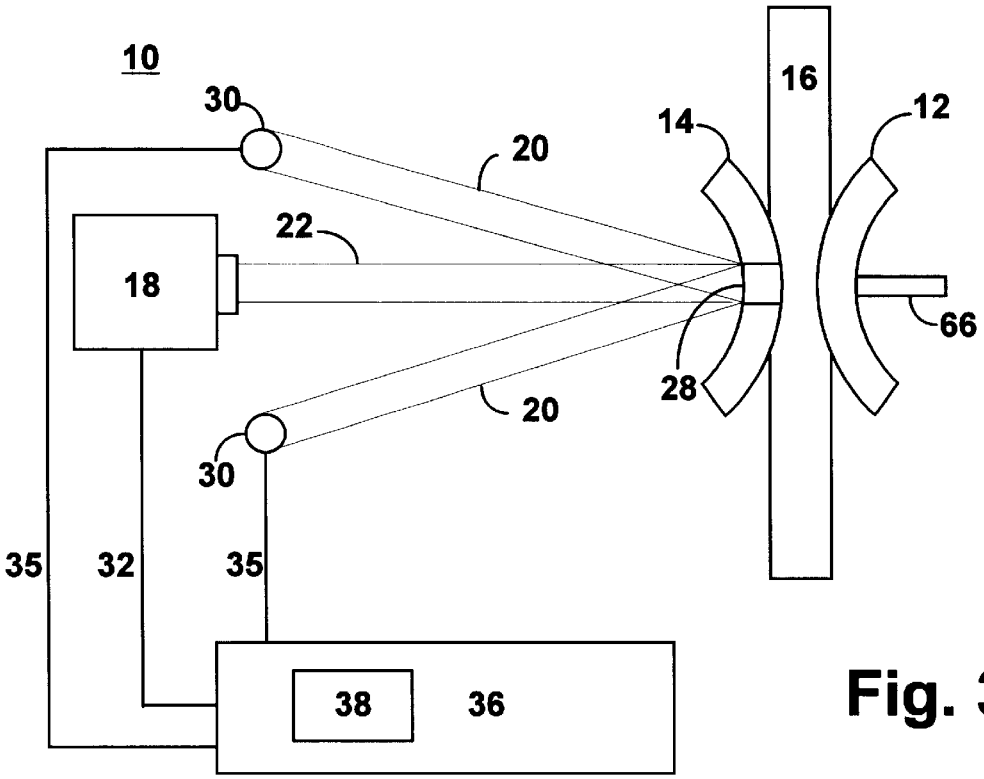
FIG. 3 is a functional diagram of a third embodiment of the on-line sliver monitor.

In an especially preferred embodiment, the space between the guide pieces 12 and 14 is adjustable. As shown in FIG. 3, the on-line sliver monitor 10 can be constructed so that the distance between the guides 12 and 14 is easily adjustable. The guide piece 12 is connected to adjustment means 66 which can be extended or retracted to alter the size of the gap between the guide pieces 12 and 14. The adjustment means may be a device such as a pneumatic or hydraulic piston, or manual or motor driven turn-screws. Control means may communicate with the adjustment means 66 to automatically set the size of the gap based on specified criteria, such as the mass of the sliver 16 of fiber, the pressure between the guides 12 and 14, the temperature of the guides 12 and 14, or the transmitted light through the sliver 16 of fiber.

To place a properly sized gap between the guides 12 and 14 that compresses the sliver 16 of fiber without causing the sliver 16 to draft, the guides 12 and 14 are first placed apart by a given distance. The fiber processing equipment pulls the sliver 16 of fiber between the guides 12 and 14. If the sliver 16 of fiber is misshapen, elongated or broken by the force of being pulled through the guides 12 and 14, the guides 12 and 14 are too close together, and are moved apart. If the sliver 16 of fiber passes freely through the guides 12 and 14, but the on-line sliver monitor 10 is unable to obtain consistent readings on the sliver 16 as described below, the guides 12 and 14 are moved closer together. Additional incremental adjustments are made by moving the guides 12 and 14 either together or apart, as described above, until impurities are satisfactorily detected without significantly drafting the sliver 16 of fiber.

As the sliver 16 of fiber is compressed between the guide pieces 12 and 14, the sliver 16 passes a first transparent window 26 and, preferably, a second transparent window 28. The windows 26 and 28 are preferably located at the point at which maximum compression of the sliver 16 of fiber occurs. Behind the first transparent window 26 is a light source 30, such as a Xenon bulb. The purpose of the light source 30 is to illuminate the compressed sliver 16 of fiber. The light source 30 is directed toward the compressed sliver 16 of fiber, and preferably produces a light 20 bright enough so that at least a portion of the light 20 penetrates the sliver 16 of fiber. A Xenon bulb operating at between about 200 volts and about 400 volts is preferred.

When the light source 30 produces the light 20, the light 20 passes through the first transparent window 26 and falls upon the compressed sliver 16 of fiber. The second transparent window 28 is preferably located directly across the sliver 16 of fiber from the first transparent window 26. Thus, when a portion of the light 20 falling upon the compressed sliver 16 of fiber penetrates the sliver 16, the light 22 passes out of the second transparent window 28. The transparent windows 26 and 28 may be formed of glass, quartz, sapphire, or appropriate thermoplastic resins. The transparent windows 26 and 28 are preferably constructed of glass.

In the preferred embodiment shown in FIG. 1, the light 22 passing out of the second transparent window 28 falls upon optics 34 (preferably a multiple lens arrangement) which are located behind the second transparent window 28, and which focus the light 22 from the second transparent window 28. The focused light 24 (an image of sliver 16) is received by a camera 18, such as a charge coupled device camera. The charge coupled device camera 18 uses an array of pixels to create an image of the compressed sliver 16 of fiber. The number of pixels needed in the array, and thus the resolution of the camera 18, depend upon the size of the trash particles to be detected in the sliver 16 and the optics 34. For example, if only relatively large particles of trash are to be detected, a camera 18 with a relatively small number of pixels could be utilized. Conversely, if the user desired to detect relatively small particles, a camera 18 with a relatively large number of pixels would be needed, as described more completely below.

The degree to which the sliver 16 of fiber is compressed tends to affect the image received by the camera 18. Reducing the width of the sliver 16 results in a narrower depth of field in which the optics 34 must focus the light 22 to form an image. Thus, compressing the sliver 16 of fiber allows the charge coupled device camera 18 to obtain a clearer image of the sliver 16 of fiber. Similarly, the type of transparent material used to construct the transparent windows 26 and 28 also tends to affect the ability of the camera 18 to obtain a sharp, clear image of the sliver of fiber 16. The cleaner and more transparent the windows 26 and 28 are, the sharper the image received by the camera 18. Thus, many factors tend to influence the clarity of the image received by the camera 18.

The relatively rapid movement of the sliver 16 of fiber through the on-line sliver monitor 10, between about 100 meters per minute and about 300 meters per minute in most mills, tends to blur the image received by the camera 18. Thus, it is desirable to stop the motion of the sliver 16 of fiber as it passes through the on-line sliver monitor 10. However, it is difficult to actually stop the motion of the sliver 16 of fiber without stopping the flow of the sliver 16 of fiber to the on-line sliver monitor 10, or causing the sliver 16 of fiber to draft. Strobing the light source 30 effectively freezes the image of the sliver 16 of fiber without the problems associated with physically stopping the motion of the sliver 16.

The light source 30 is strobed at a rate that is relatively fast as compared to the speed of the sliver 16 of fiber as it passes through the on line sliver monitor 10. Thus, during the short duration of the light pulse 20, the sliver 16 moves a relatively short distance. Similarly, the camera 18 preferably has a pixel array capable of capturing an image in a relatively short period of time. This also tends to minimize any substantial blurring of the image created of the compressed sliver 16 of fiber. In the preferred embodiment, the fast response time of the camera 18 and the ability of the light source 30 to be rapidly strobed help allow the on-line sliver monitor 10 to monitor the sliver 16 of fiber without halting its progress through the fiber processing equipment. A similar result could be obtained by use of a shutter to open and close the lens aperture of the camera 18.

In the preferred embodiment, trigger signals are provided simultaneously to the light source 30 and the charge coupled device camera 18 on lines 35 and 32 respectively. These trigger signals could be generated in a number of ways. For instance, they could be created by a pulse generator 38. When the trigger signal is received by the light source 30 on line 35, the light source 30 produces a bright flash of light 20, or in other words, strobes. At the same instant that the light source 30 strobes, the camera 18 receives the trigger signal from the pulse generator 38 on line 32 and captures the image of the strobed sliver 16 of fiber in the focused light 24 with the array of pixels.

Figure 2:
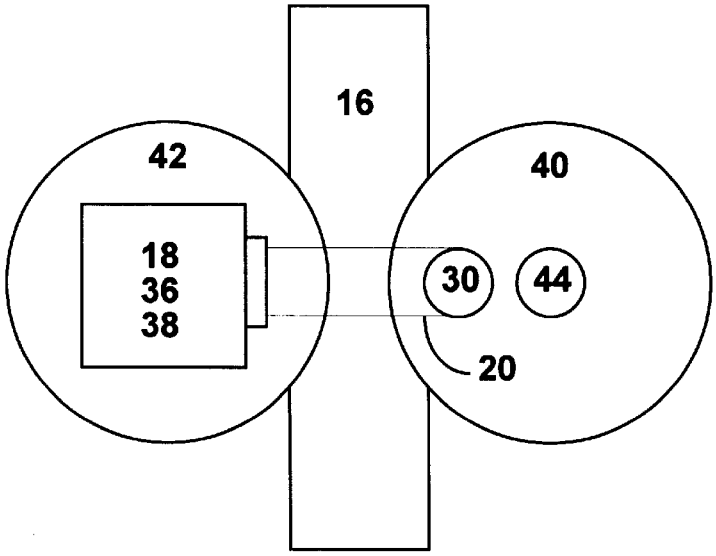
FIG. 2 is a functional diagram of a second embodiment of the on-line sliver monitor.

An alternate embodiment of the on-line sliver monitor 10 is shown in FIG. 2. Instead of the curved guide pieces 12 and 14 receiving the sliver 16 of fiber, a pair of cylindrical rollers 40 and 42 receives the sliver 16 of fiber. The rollers 40 and 42 are spaced apart a distance that corresponds to the maximum desired amount of compression of the sliver 16 of fiber. Preferably, the rollers 40 and 42 are mounted in a configuration that allows the distance between them, and thus the compression of the sliver 16 of fiber, to be adjusted relatively easily. One of the rollers 40 and 42 spins in a clockwise direction, while the other one of the rollers 40 and 42 spins in a counter-clockwise direction, according to the direction of travel of the sliver 16 of fiber. The rotational speed of the rollers 40 and 42 is synchronized to the speed at which the sliver 16 of fiber is received by and pulled from the on-line sliver monitor 10.

Thus, the embodiment of the on-line sliver monitor 10 shown in FIG. 2 avoids drafting the sliver 16 of fiber in a different manner than the embodiment shown in FIG. 1. The first and second rollers 40 and 42 compress the sliver 16 of fiber as it moves between them. By synchronizing the rotational speed of the rollers 40 and 42 to the speed at which the sliver 16 of fiber is being received, the on-line sliver monitor 10 shown in FIG. 2 does not draft the sliver 16 of fiber. Since the surface of the rollers 40 and 42 moves as fast as the sliver 16 of fiber, there is no significant frictional force to draft the sliver 16 of fiber. Thus, it is not as important that the surface of the rollers 40 and 42 be covered with a low surface friction material such as Teflon or ceramic. In one variation of this embodiment of the on-line sliver monitor 10, the rollers 40 and 42 have a relatively high surface friction that prevents the sliver 16 of fiber from substantially slipping relative to the rollers 40 and 42. However, as more fully discussed below, the surfaces of the rollers 40 and 42 that are in physical contact with the sliver 16 of fiber are preferably constructed in a manner that does not distort the light 26 passing through the transparent portions of the rollers 40 and 42.

In the alternate embodiment of the on-line sliver monitor 10 shown in FIG. 2, the charge coupled device camera 18 may be located inside of the second roller 42. The camera 18 preferably remains stationary while the rollers 40 and 42 spin. At least a section of the second roller 42 is preferably constructed out of a transparent material, as described above for the windows 26 and 28, so that the light 20 passing through the sliver 16 of fiber can reach the camera 18. The entire roller 42 may be constructed from the transparent material or, alternatively, a band of transparent material may be built into the roller 42 around the circumference where the roller 42 contacts the sliver 16 of fiber.

The sliver 16 of fiber is pulled between the rollers 40 and 42 by the rotating action of the rollers 40 and 42, which may be powered by a motor 44. Alternatively, the sliver 16 of fiber is pulled by a force external to the on-line sliver monitor 10, with the rollers 40 and 42 freely spinning at a rate that equals the speed of the sliver 16 of fiber.

The Xenon bulb 30 or other suitable light source 30 is located inside the first roller 40. The first roller 40 is preferably constructed out of transparent material in a manner similar to the second roller 42 as discussed above. Thus, when the bulb 30 flashes, light 20 passes through the first roller 40 and into the compressed sliver 16 of fiber. The light 20 penetrates the sliver 16 of fiber and travels through the second roller 42 and into the charge coupled device camera 18. As previously discussed, it is not necessary that either of the transparent rollers 40 and 42 be entirely transparent. The transparent portions of the rollers 40 and 42 may consist of a narrow transparent band extending around the circumference of the rollers 40 and 42.

In yet another embodiment, the rollers 40 and 42 have small transparent windows located on their circumference. As the window in the first transparent roller 40 spins past the compressed sliver 16 of fiber, the corresponding window in the second transparent roller 42 also comes in contact with the sliver 16 of fiber. At that moment when both windows are aligned with each other and in contact with the compressed portion of the sliver 16 of fiber, the light source 30 is strobed and the camera 18 is activated. The optics 34 shown in FIG. 1 may be placed inside of the second roller 42 of FIG. 2.

The lines 32 and 35 that connect the processing means 36 to the camera 18 and the light source 30 are not shown in FIG. 2. In the embodiment shown in FIG. 2, the camera 18, the processing means 36 and the pulse generator 38 are all contained in one unit that is located in the second roller 42. Thus, it is not essential that the processing means 36 are physically separate from the pulse generator 38 or the charge coupled device camera 18.

Figure 4:
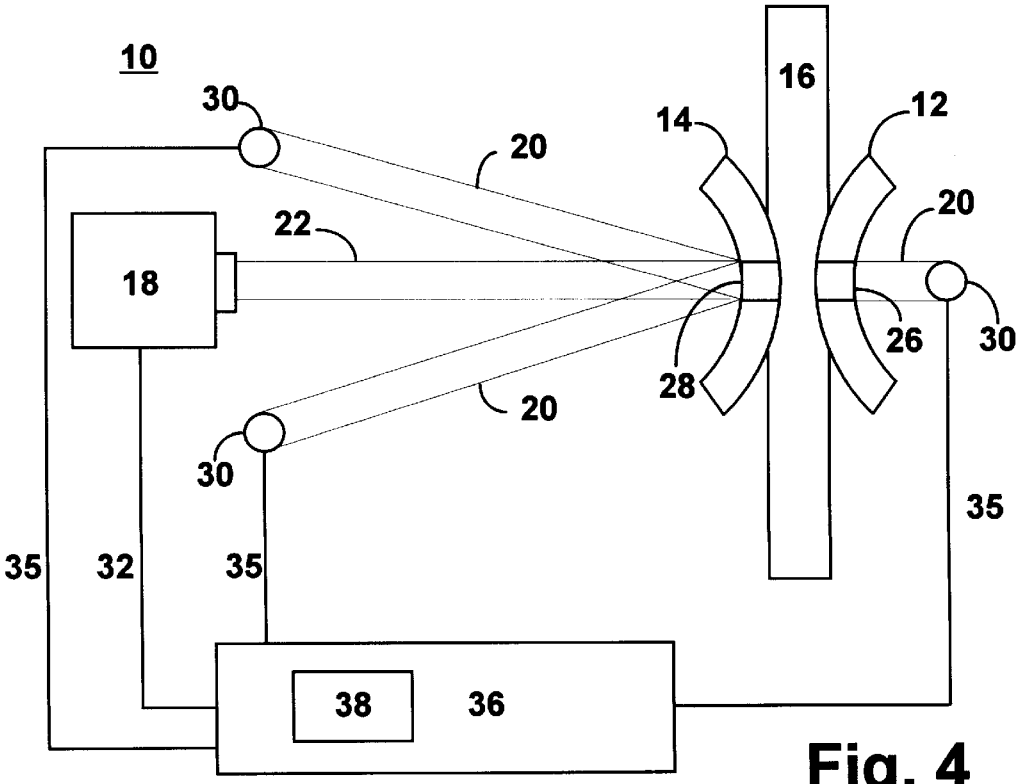
FIG. 4 is a functional diagram of a fourth embodiment of the on-line sliver monitor.

As shown in FIG. 3, the on-line sliver monitor 10 can also be constructed with one transparent window 28. The light 20 is provided to the sliver 16 by one or more light sources 30 positioned so as to illuminate the sliver 16 of fiber as it passes the transparent window 28. Furthermore, depending upon the amount of ambient light available, the light sources 30 may be eliminated and the sliver 16 illuminated with available light. Regardless of whether light is provided by the light sources 30 or ambient light, the light 22 is reflected back toward the camera 18. The light 22, which in this embodiment is reflected toward the camera 18, may be reflected by either the sliver 16 of fiber, or off the guide piece 12, which may be coated with a material which enhances the reflective nature of the guide piece 12. The camera 18 receives the reflected light 22 and creates an image of the sliver 16. As shown in FIG. 4, an embodiment may utilize both reflected and transmitted light to illuminate the sliver 16 of fiber.

Once an image of the compressed sliver 16 of fiber is obtained, processing means 36 are used to analyze the image received from the array of pixels for trash and neps. In a preferred embodiment, the processing means 36 is a microcomputer such as a personal computer. The processing means 36 may include a display, keyboard, and input/output circuitry suitable for interfacing with the camera 18, pulse generator 38 and light source 30. The processing means 36 may also contain random access memory and secondary memory consisting of a hard or floppy disk drive. The processing means 36 may include the control means described above. A computer program preferably controls the processing of the on-line sliver monitor 10 by storing the results of previous measurements and analyzing the results of current measurements.

Trash and neps generally show up as dark spots in the captured image of the sliver 16 of fiber. When the light 20 from the light source 30 falls upon the sliver 16 of fiber, denser portions of the sliver 16 tend to allow less light 22 and 24 to pass through to the camera 18. Thus, to a large degree, the dark pixels will represent denser portions of the sliver 16. However, the degree to which light 20 passes through the impurities determines the amount of light 24 that reaches the pixels that are imaging the portion of the sliver 16 occupied by the impurity. A tight dense knot of fibers, or an opaque piece of a leaf, will prevent the light 20 from the source 30 from passing through the sliver 16, and will result in a dark spot in the image created by the array of pixels. Thus, one function of the processing means 36 is to locate the dark spots in the sliver 16 of fiber by examining the array of values output by the camera 18.

The output of each of the pixels in the array of pixels is a voltage representing the amount of light received by the pixel. Thus, the output is preferably not simply an on or off state, but can vary between a wide range of values. The actual range of values that the pixel can possibly output depends upon the particular device utilized. In addition, the array of pixels selected depends upon the type of impurity to be detected.

The processing means 36 compares the voltage output of each pixel in the array of pixels to a threshold value and designates all pixels that are darker than the threshold darkness as dark pixels. Depending upon the type of camera 18 utilized, a higher voltage value may represent either a darker or a lighter pixel. Furthermore, the darkness of the pixels may be even represented by a digital value output by the camera 18. In other words, the processing means 36 selects the darker pixels regardless of the form of output used to represent the darkness of the pixels.

For example, the output of a pixel may be a number between 0 and 255. The value of 255 indicates that the pixel received the lowest possible detectable amount of light and a value of 0 indicates that the pixel received the highest possible amount of detectable light.

If the threshold value is 150, all pixels above 150 are designated as dark.

As another example, the output of the pixels may be a voltage between zero and five volts, where a value of five volts indicates the pixel received the highest amount of detectable light and a value of zero volts indicates the pixel received the lowest amount of detectable light. If the threshold value is three volts, all pixels below three volts are designated as dark pixels.

The threshold value is preferably adjustable lighter or darker depending upon the characteristics of the sliver 16 of fiber monitored by the on-line sliver monitor 10 and the nature of the impurities to be detected. As previously stated, most impurities in the sliver 16 of fiber appear as dark spots. For example, if only very dark impurities are to be detected, the threshold level can be made more dark. All pixels lighter than this threshold level are eliminated from consideration as possible trash or neps.

Furthermore, in the preferred embodiment, all remaining dark pixels that are not contiguous with at least three other dark pixels are eliminated from consideration. This allows the processing means 36 to eliminate artifacts that are considered too small to warrant further attention. Nevertheless, if desired, the processing means 36 could be programmed to not eliminate pixels that are contiguous to a number other than three dark pixels. The number of contiguous dark pixels that are required before a pixel is eliminated from consideration is largely dependent upon the resolution of the camera 18 used in the on-line sliver monitor 10 and the size of the objects to be identified.

For example, if a high resolution camera 18 uses a relatively large number of pixels to represent a given surface area, a large number of contiguous dark pixels may represent a relatively small impurity. By eliminating dark pixels not contiguous to many other dark pixels, the processing means 36 may be able to eliminate from further consideration impurities that are too small to warrant further consideration. As a specific example, the camera 18 may have a pixel density of twenty-five pixels per square inch. If a piece of trash was only large enough to darken three of the pixels, then eliminating all pixels not contiguous to three additional pixels would eliminate this impurity from consideration. However, if a higher resolution camera 18 is used that has a pixel density of 100 pixels per square inch, the same impurity would result in six contiguous dark pixels. The number of dark pixels used to represent a piece of trash is directly proportional to the number of pixels used to represent a given area. Thus, it can be seen that the performance of the on-line sliver monitor 10 is altered by changing the resolution of the camera 18. Therefore, the resolution of the camera 18 is preferably considered when programming the processing means 36 to manipulate the pixel information received from the camera 18.

In a preferred embodiment of the invention, the voltage values for the dark pixels are binned from 0–255. These values represent the grayness of each pixel in the array of pixels. The grayness value is preferably determined after pixels that are lighter than the threshold value, or not contiguous to a predetermined number of other dark pixels, have been eliminated from consideration. Thus, the 256 possible grayness levels represent a smaller voltage range, and thus have a higher effective resolution. For example, if the threshold darkness was represented by three volts and the maximum darkness was represented by five volts, the processing means would preferably divide the range from three volts to five volts into 256 grayness levels. More levels or fewer levels could be used to represent the grayness of the pixels if desired. The processing means 36 examines the patterns of dark pixels to determine what they represent, as described more completely below. This is accomplished by examining the darkness of the patterns of pixels, the fuzziness of the patterns, and the shape of the patterns.

Figures 5, 6, 7, 8, 9:
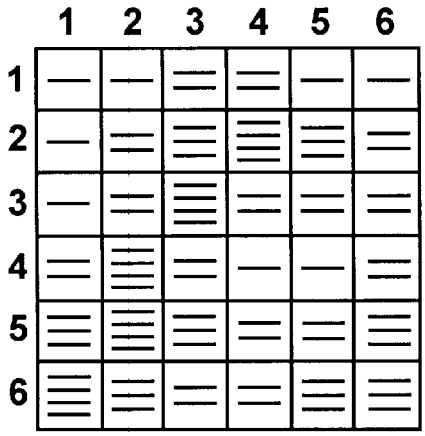
FIG. 5 depicts the varying darkness of different areas of a sliver of fiber.
FIG. 6 depicts the array of values created by the array of pixels.
FIG. 7 depicts the array of values after values below the threshold darkness requirement have been eliminated from consideration by the processing means.
FIG. 8 depicts the array of values after noncontiguous pixels have been eliminated.
FIG. 9 depicts the array of grayness values created by the processing means.

For example, FIG. 5 depicts the output from a camera 18 with a 6 by 6 array of pixels. FIG. 5 is overly simplified in that the camera 18 used in an actual on-line sliver monitor 10 would tend to have many more than thirty-six pixels. For example, the camera 18 of the preferred embodiment has an array of 340,000 pixels. Nevertheless, the general approach described is exemplary of the actual approach used in a preferred embodiment.

In FIG. 5, lines are used to represent the relative darkness of each pixel in the array, which relates to the relative density of the portion of the sliver 16 of fiber imaged by the pixel. More lines are used to indicate denser areas of the sliver 16 of fiber and less lines are used to indicate less dense, more transparent areas of the sliver 16. The camera 18 creates the array of voltage values shown in FIG. 6 from the image depicted in FIG. 5. The processing means 36 receives the array of values shown in FIG. 6 from the camera 18. Assuming a threshold value of 2.5 volts, the processing means 36 eliminates from consideration the values below 2.5 volts. The resulting array of values is shown in FIG. 7.

All the remaining pixels represented by the values shown in FIG. 7 would thus be considered dark pixels. The processing means 36 eliminates all dark pixels that are not part of a contiguous string of at least four dark pixels. Thus, the result would be the array of FIG. 8. The processing means 36 assigns a grayness value between 0–255 to the remaining pixels based on the voltage signals received from the pixels, producing the array shown in FIG. 9.

By examining the darkness, fuzziness, shape, and size of the remaining patterns of pixels, the processing means 36 preferably determines the type of impurity. For example, a nep may diminish the light passing through it to the point that the pixels representing the nep exceed the darkness threshold. A piece of leaf may also diminish the light passing through it to the point that the pixels representing it exceed the darkness threshold. However, the light passing through the leaf tends to be diminished to a greater degree than the light passing through the nep. In one embodiment, dark pixels having values within the darkest ten percent of the range of dark pixels are considered an indication that the impurity which produced them was trash and not neps. Thus, the degree or level of darkness of the patterns of dark pixels is preferably used by the processing means 36 to help identify the impurity.

Likewise, the fuzziness of the pattern tends to indicate the type of impurity detected. Fuzziness refers to the rate of change in the darkness of the pixels across a cross section of the pattern. In other words, some impurities have sharp edges and create a rapid change in the amount of light that passes through them. A piece of leaf is a good example of this type of impurity. At the edge of the leaf, the amount of light transmitted undergoes a dramatic change. Just to the outside of the edge of the leaf, the light is transmitted at some base level, and just to the inside of the edge of the leaf the light is transmitted at a dramatically decreased level.

Other types of impurities tend to produce a more gradual change in the amount of light that is transmitted. For example, a nep typically does not have an edge profile similar to the leaf described above. A nep tends to have a relatively more dense core surrounded by a relatively less dense periphery. Thus, the change in the amount of light transmitted just outside of the edge of the nep and just inside of the edge of the nep is not very great in comparison to the change at the edge of a leaf. However, unlike the profile of the leaf, the amount of light transmitted continues to change across the profile of the nep, moving from the edge of the nep to the center of the nep. Typically, the center of the nep will be the darkest area of the nep, and the amount of light transmitted will gradually increase in all directions away from the center of nep.

For example, the fuzziness of an impurity can be detected by constructing a histogram of pixel darkness across one or more scan lines of pixels representing the impurity. The highest and lowest light transmission levels are used to normalize the histogram to values between zero and one, or some other values such as zero and 255. Next, the darkness values are ordered by degree of darkness (or in other words, from lightest to darkest), rather than by linear position in the pattern. The modified histogram thus depicts normalized darkness values across one axis, and the number of pixels per darkness value across the other axis.

In this manner, the histogram provides an edge profile for the impurity. In other words, the histogram depicts how rapidly the transmission of light changes across the impurity. If the histogram shows a steep edge, it indicates that the change in light transmission occurs very rapidly across the impurity, and not many pixels of intermediate intensity are detected. If, however, the histogram shows a very gradual rise, it indicates that the change in light transmission occurs relatively slowly across the impurity, and many pixels of intermediate intensity are detected.

The width of the edge depicted in the histogram can be used to assign a fuzziness level to the impurity. In other words, when the slope depicted in the histogram is steep, the fuzziness level of the impurity decreases, and when the slope depicted in the histogram is gradual, the fuzziness level of the impurity increases. In one embodiment, a fuzziness level greater than one, representing a slope of forty-five degrees, is used as an indication that the impurity is a piece of trash, and not a nep. Other values may also be used, based on the empirical data gathered from the on-line monitor as it processes a sliver. Thus, the processing means 36 preferably detects the fuzziness level and uses the information to help identify the impurity.

Preferably, the shape of the pattern of dark pixels is also used by the processing means 36 to help identify the impurity. Entanglement neps, seed coat neps, leaves, twigs, and other impurities all tend to have distinctive shapes. The processing means determines a shape profile for the impurity that has been detected, and uses the determined shape to help identify the impurity. Shape can be determined with merging and splitting techniques to approximate the boundary of the impurity with a polygon. Another method for determining the shape of an impurity is to define a one-dimensional signature of the impurity's boundary. In accordance with this method, the distance from the centroid of the impurity to the periphery of the impurity is recorded as a function of the angle of the centroid. This method is particularly suited to recognizing impurities with a high degree of radial symmetry. In the preferred embodiment, more than one pattern recognition method is used to help identify the impurity.

For example, leaves and twigs tend to have a relatively high aspect ratio. In other words, one dimension of a leaf or twig, such as length, tends to be much greater than another dimension of the leaf or twig, such as width. Conversely, neps tend to have a relatively low aspect ratio, meaning that the measurements of a nep tend to be more equal in all directions. The processing means 36 analyzes the pattern of dark pixels and determines the aspect ratio. In one embodiment, an aspect ratio greater than two is used as an indication that the impurity is trash, and not a nep. Thus, the shape of the pattern of dark pixels is preferably used by the processing means 36 to help identify the impurity.

Size may also be used to identify impurities in the sliver 16 of cotton fiber. The total size of the impurity is calculated by counting all the contiguous dark pixels. As previously discussed, impurities or other artifacts in the image smaller than a predetermined number of contiguous pixels are eliminated from further consideration. Similarly, if a pattern of pixels is greater than a predetermined number of contiguous pixels, either in diameter or in total size, it may also be eliminated from further consideration. Between these two extremes, empirical data gathered from the sliver can be used to identify impurities. For example, a specific gin may find that trash in its feed stream tends to be larger than the neps. Thus, the processing means 36 can be programmed such that a pattern of pixels over a given size is used as an indication that the impurity is trash and not a nep. Thus, the size is preferably used to help identify the impurity.

The levels of darkness and fuzziness and the shape and size data can be used by the processing means 36 in different ways. The levels or values assigned to each of the criteria can be put into an equation to identify the impurity. Alternately, the levels are compared by the processing means 36 to a lookup table to determine what type of impurity is represented. The lookup table contains darkness, fuzziness, shape, and size data from known types of impurities. If the darkness, fuzziness, shape, and size data calculated by the processing means 36 closely corresponds to the data for a known impurity, the pattern of dark pixels is identified as that type of impurity. This information can be fed backward or forward to control fiber processing equipment to reduce or eliminate the impurity. Each image of the compressed sliver 16 of fiber is preferably analyzed before the next image is acquired. A single processing means 36 may be employed to monitor several on-line sliver monitors 10.

While specific embodiments of the invention have been described with particularity above, it will be appreciated that the invention comprehends rearrangement and substitution of parts within the spirit of the appended claims.

What is claimed is:

1. A device for measuring properties of substantially parallel, untwisted fiber in a sliver of fiber having a substantially round cross-section with a diameter while it is moving at a high rate of linear speed through fiber processing equipment without breaking or drafting the sliver of fiber comprising:

a guide having opposing convex guides for receiving the sliver of fiber as the sliver continuously moves between the guides without drafting the sliver, the opposing convex guides having opposing convex surfaces for contacting the sliver, with a separation between the surfaces that gradually transitions from greater than the diameter of the sliver where the sliver enters the guide to less than the diameter of the sliver where the surfaces are closest together, for receiving and applying compression to flatten the sliver of fiber and then releasing and removing compression from the sliver of fiber as it continuously moves through the guide, a light source for producing light for illuminating the sliver as the sliver is compressed and flattened between the guides;

a transparent window located in each of the convex guides where the guide surfaces are closest together, the windows for receiving the light from the light source and providing the light to the compressed and flattened sliver of fiber while it is under compression and flattened, and for receiving the light from the compressed and flattened sliver of fiber while it is under compression and flattened, and a camera for receiving the light from the transparent windows and creating an image of the compressed and flattened sliver of fiber while it is under compression and flattened.

2. The device of claim 1 further comprising a pulse generator for providing simultaneous trigger signals to the light source and the camera, the trigger signal to the camera causing the camera to create the image of the compressed sliver of fiber, and the trigger signal to the light source causing the light source to produce light.

3. The device of claim 1 further comprising optics for receiving the light from the transparent window and focusing the light upon the camera.

4. The device of claim 1 wherein the light source further comprises a Xenon bulb.

5. The device of claim 1 wherein the light produced by the light source is reflected by the sliver of fiber and received by the camera.

6. The device of claim 1 wherein the camera comprises a charge coupled device camera having an array of pixels for creating the image of the compressed sliver of fiber.

7. The device of claim 6 further comprising a processing means for receiving and analyzing the image of the compressed sliver to identify impurities in the sliver.

8. The device of claim 7 wherein the processing means identifies impurities in the sliver by analyzing the images for darkness, fuzziness, and shape.

9. The device of claim 7 wherein the processing means identifies impurities in the sliver by relative intensity of different wavelengths of the light received by the camera.

10. The device of claim 7 wherein the processing means classifies impurities according to size.

11. The device of claim 1 further comprising:

the camera further comprising a charge coupled device camera having an array of pixels for creating the image of the compressed sliver of fiber, and a processing means for receiving and analyzing the image of the compressed sliver of fiber created by the camera, and further for detecting impurities in the compressed sliver of fiber by selecting as dark pixels those pixels which exceed a threshold, selecting the dark pixels that are contiguous to at least four other dark pixels, the contiguous dark pixels forming patterns, assigning the selected dark pixels a value representing the dark pixel's darkness, and comparing the patterns of dark pixels and darkness values against a lookup table to detect impurities in the compressed sliver of fiber.

12. The device of claim 1 wherein the transparent window and guide further comprise:

first and second transparent rollers for receiving and compressing the sliver of fiber, the light source located inside the first transparent roller, and the camera located inside the second transparent roller.

13. The device of claim 1 wherein the transparent window further comprises:

a first transparent window located in the guide for receiving the light from the light source and providing the light to the compressed sliver of fiber while it is under compression, and a second transparent window located in the guide for receiving the light from the compressed sliver of fiber while it is under compression.

14. The device of claim 1 wherein the compression of the sliver of fiber by the guide is adjustable.

15. The device of claim 1 wherein the guide further comprises a pair of curved guide pieces separated by an adjustable distance.

16. The device of claim 15 wherein the distance between the curved guide pieces is controlled by a piston mounted to at least one of the curved guide pieces.

17. The device of claim 1 wherein the transparent window further comprises the lens of the camera.

18. A device for measuring properties of a sliver of fiber comprising:

a guide for receiving and compressing the uncompressed sliver of fiber the guide having a pair of curved aluminum side pieces coated with at least one of Teflon and ceramic to form an open trumpet for compressing the sliver of fiber without drafting the sliver of fibers, a light source for producing light;

a transparent window located in the guide for receiving the light from the light source and providing the light to the compressed sliver of fiber, and for receiving the light from the compressed sliver of fiber, and a camera for receiving the light from the transparent window and creating an image of the compressed sliver of fiber.

19. A device for measuring properties of substantially parallel, untwisted fiber in a sliver of fiber having a substantially round cross-section while it is moving at a high rate of linear speed through fiber processing equipment without breaking or drafting the sliver of fiber comprising:

first and second opposing curved aluminum guides for receiving the sliver of fiber as the sliver continuously moves between the guides, the opposing curved guides forming an open trumpet having opposing curved surfaces for contacting the sliver, with a separation between the surfaces that gradually transitions from greater than the diameter of the sliver where the sliver enters the guide to less than the diameter of the sliver where the surfaces are closest together, the surfaces coated with at least one of Teflon and ceramic for receiving and applying compression to flatten the sliver of fiber and then releasing and removing compression from the sliver of fiber as the sliver continuously moves through the guide without drafting the sliver of fiber, a Xenon bulb for providing light, a first transparent window located in the first curved aluminum guide piece for receiving the light from the bulb and providing the light to the compressed and flattened sliver of fiber while it is under compression and flattened, a second transparent window located in the second curved aluminum guide piece for receiving the light from the compressed and flattened sliver of fiber while it is under compression and flattened, a charge coupled device camera for receiving the light from the second transparent window and having an array of pixels for creating an image of the compressed and flattened sliver of fiber while it is under compression and flattened, optics for receiving the light from the second transparent window and focusing the light upon the charge coupled device camera, a pulse generator for providing simultaneous trigger signals to the Xenon bulb and the charge coupled device camera, the trigger signal to the camera causing the camera to create the image of the compressed and flattened sliver of fiber, and the trigger signal to the Xenon bulb causing the bulb to produce light, and a processing means for receiving and analyzing the image of the compressed and flattened sliver of fiber created by the camera, and further for detecting impurities in the compressed and flattened sliver of fiber by selecting as dark pixels those pixels which exceed a threshold, selecting the dark pixels that are contiguous to at least four other dark pixels, the contiguous dark pixels forming patterns, assigning the selected dark pixels a value representing the dark pixel's darkness, classifying the patterns of dark pixels by examining the patterns of dark pixels to determine a darkness level, a fuzziness level, and a shape, and comparing the patterns of dark pixels and darkness values against a lookup table to detect impurities in the compressed and flattened sliver of fiber.

20. A method of monitoring properties of substantially parallel, untwisted fiber in a sliver of fiber having a substantially round cross-section with a diameter while it is moving at a high rate of linear speed through fiber processing equipment without breaking or drafting the sliver of fiber comprising the steps of:

providing a guide with opposing convex guides having opposing convex surfaces for contacting the sliver, with a separation between the surfaces that gradually transitions from greater than the diameter of the sliver where the sliver enters the guide to less than the diameter of the sliver where the surfaces are closest together, receiving the sliver between the surfaces of the guide where the separation between the surfaces is greater than the diameter of the sliver, continuously passing the sliver between the surfaces of the guide where the separation between the surfaces is less than the diameter of the sliver, thereby compressing and flattening the sliver of fiber between the guides, directing a light toward the compressed and flattened sliver of fiber while the sliver is in compression and flattened between the opposing guides, with at least a portion of the light passing through the compressed and flattened sliver of fiber while it is under compression and flattened, receiving the portion of light passing through the compressed and flattened sliver of fiber while it is under compression and flattened with an array of pixels, creating an image of the compressed and flattened sliver of fiber while it is under compression and flattened with the array of pixels, analyzing the image of the compressed and flattened sliver of fiber to locate impurities in the compressed and flattened sliver of fiber, and releasing the sliver of fiber without drafting the sliver of fiber.

21. The method of claim 20 further comprising the step of providing simultaneous trigger signals to synchronize the directing of the light with creating the image of the compressed sliver of fiber with the array of pixels.

22. The method of claim 20 wherein the light directed toward the sliver of fiber is produced by a strobing light source.

23. The method of claim 20 further comprising the step of focusing the portion of light passing through the compressed sliver of fiber onto the array of pixels.

24. The method of claim 20 further comprising:

the directing step further comprising directing a strobed light toward the compressed sliver of fiber, at least a portion of the strobed light passing through the compressed sliver of fiber while it is under compression between the opposing guides, focusing the portion of strobed light passing through the compressed sliver of fiber, the receiving step further comprising receiving the focused portion of strobed light passing through the compressed sliver of fiber while it is under compression with an array of pixels, providing simultaneous trigger signals to synchronize the strobed light and the array of pixels, and the creating step further comprising creating an image of the compressed sliver of fiber while it is under compression from the focused portion of strobed light with the array of pixels.

25. A method of sensing properties of substantially parallel, untwisted fiber in a sliver of fiber having a substantially round cross-section with a diameter while it is moving at a high rate of linear speed through fiber processing equipment without breaking or drafting the sliver of fiber comprising the steps of:

providing a guide with opposing convex guides having opposing convex surfaces for contacting the sliver, with a separation between the surfaces that gradually transitions from greater than the diameter of the sliver where the sliver enters the guide to less than the diameter of the sliver where the surfaces are closest together, receiving the sliver between the surfaces of the guide where the separation between the surfaces is greater than the diameter of the sliver, continuously passing the sliver between the surfaces of the guide where the separation between the surfaces is less than the diameter of the sliver, thereby compressing and flattening the sliver of fiber between the guides, passing light through the compressed and flattened sliver of fiber while it is under compression and flattened between the opposing guides to create an image of the fiber in the sliver of fiber while it is under compression and flattened, receiving the image of the sliver of fiber, and analyzing the image to detect the properties of the sliver of fiber.

26. The method of claim 25 further comprising the step of synchronizing the illuminating of the compressed sliver of fiber to the receiving of the image.

27. The method of claim 25 further comprising the step of adjusting the amount of compression of the sliver of fiber.

28. The method of claim 25 further comprising the step of releasing the sliver of fiber without drafting the sliver of fiber.

29. A device for measuring properties of substantially parallel, untwisted fiber in a sliver of fiber having a substantially round cross-section with a diameter while it is moving at a high rate of linear speed through fiber processing equipment without breaking or drafting the sliver of fiber comprising:

a guide having opposing convex guides for receiving the sliver of fiber as the sliver continuously moves between the guides without drafting the sliver, the opposing convex guides having opposing convex surfaces for contacting the sliver, with a separation between the surfaces that gradually transitions from greater than the diameter of the sliver where the sliver enters the guide to less than the diameter of the sliver where the surfaces are closest together, thereby compressing and flattening the sliver of fiber as it continuously moves through the guide, a transparent window located in each of the convex guides where the guide surfaces are closest together, the windows for receiving light from the compressed and flattened sliver of fiber while it is under compression and flattened, a camera for receiving light from the transparent windows and creating an image of the compressed and flattened sliver of fiber while it is under compression and flattened, and a processing means for receiving and analyzing the image of the compressed and flattened sliver of fiber to identify impurities in the sliver of fiber.

30. A device for measuring properties of substantially parallel, untwisted fiber in a sliver of fiber having a substantially round cross-section while it is moving at a high rate of linear speed through fiber processing equipment without breaking or drafting the sliver of fiber comprising:

first and second opposing curved guides for receiving the sliver of fiber as the sliver continuously moves between the guides, the opposing curved guides forming an open trumpet having opposing curved surfaces for contacting the sliver,with a separation between the surfaces that gradually transitions from greater than the diameter of the sliver where the sliver enters the guides to less than the diameter of the sliver where the surfaces are closest together, the surfaces for receiving and applying compression to flatten the sliver of fiber and then releasing and removing compression from the sliver of fiber as the sliver continuously moves through the guide without drafting the sliver of fiber, a bulb for providing light, a first transparent window located in the first curved guide piece for receiving the light from the bulb and providing the light to the compressed and flattened sliver of fiber while it is under compression and flattened, a second transparent window located in the second curved guide piece for receiving the light from the compressed and flattened sliver of fiber, while it is under compression and flattened, a charge coupled device camera for receiving the light from the second transparent window and having an array of pixels for creating an image of the compressed and flattened sliver of fiber while it is under compression and flattened, optics for receiving the light from the second transparent window and focusing the light upon the charge coupled device camera, a pulse generator for providing simultaneous trigger signals to the bulb and the charge coupled device camera, the trigger signal to the camera causing the camera to create the image of the compressed and flattened sliver of fiber, and the trigger signal to the bulb causing the bulb to produce light,and a processing means for receiving and analyzing the image of the compressed and flattened sliver of fiber created by the camera, and further for detecting impurities in the compressed and flattened sliver of fiber.

31. The device of claim 30 wherein the processing means further comprises means for:

selecting as dark pixels those pixels which exceed a threshold, selecting the dark pixels that are contiguous to at least four other dark pixels, the contiguous dark pixels forming patterns, assigning the selected dark pixels a value representing the dark pixel's darkness, classifying the patterns of dark pixels by examining the patterns of dark pixels to determine a darkness level, a fuzziness level, and a shape, and comparing the patterns of dark pixels and darkness values against a lookup table to detect impurities in the compressed sliver of fiber.

* * * * *